US008366876B2

(12) United States Patent
Saetherasen

(10) Patent No.: US 8,366,876 B2
(45) Date of Patent: Feb. 5, 2013

(54) METHOD AND ARRANGEMENT FOR IMPROVING A WASHING STEP AFTER COMPLETED COOKING IN A CONTINUOUS DIGESTER

(75) Inventor: Jonas Saetherasen, Hammaro (SE)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 13/513,615

(22) PCT Filed: Dec. 20, 2010

(86) PCT No.: PCT/SE2010/051441

§ 371 (c)(1), (2), (4) Date: Jun. 4, 2012

(87) PCT Pub. No.: WO2011/078775

PCT Pub. Date: Jun. 30, 2011

(65) Prior Publication Data

US 2012/0241112 A1 Sep. 27, 2012

(30) Foreign Application Priority Data

Dec. 23, 2009 (SE) ..... 0901602

(51) Int. Cl.
*D21C 7/00* (2006.01)
*D21C 9/02* (2006.01)

(52) U.S. Cl. ..... 162/60; 162/52; 162/237; 162/246

(58) Field of Classification Search ..... 162/60
See application file for complete search history.

(56) References Cited

U.S. PATENT DOCUMENTS

| | | | | |
|---|---|---|---|---|
| 3,085,624 | A | 4/1963 | Horstman | |
| 3,259,538 | A | 7/1966 | Schnyder | |
| 5,650,045 | A * | 7/1997 | Salminen | 162/19 |
| 5,919,337 | A | 7/1999 | Olsson et al. | |
| 2008/0202717 | A1 * | 8/2008 | Saetherasen et al. | 162/237 |

FOREIGN PATENT DOCUMENTS

| | | |
|---|---|---|
| SE | EP1203841 | 5/2002 |
| SE | WO2006101449 | 9/2006 |
| SE | 533610 C2 * | 9/2010 |
| WO | WO 2010110724 A1 * | 11/2010 |

* cited by examiner

*Primary Examiner* — Matthew Daniels
*Assistant Examiner* — Eric Yaary
(74) *Attorney, Agent, or Firm* — Rolf Fasth; Fasth Law Offices

(57) ABSTRACT

The method and an arrangement are for the improvement of a wash after completed digestion in a continuous digester for the production of cellulose pulp. The softened chips are exposed to a radially directed displacement wash after they have passed the rotating bottom scraper. The displacement wash has been established in the flow of digested softened chips through the outlet tap before the softened chips are defibrated by the fall in pressure across the blow-valve that is arranged after the digester.

6 Claims, 4 Drawing Sheets

← Fig. 1B
*Prior Art*

METHOD AND ARRANGEMENT FOR IMPROVING A WASHING STEP AFTER COMPLETED COOKING IN A CONTINUOUS DIGESTER

PRIOR APPLICATION

This application is a U.S. national phase application that is based on and claims priority from International Application No. PCT/SE2010/051441, filed 20 Dec. 2010 that claims priority from Swedish Patent Application Number 0901602-3, filed 23 Dec. 2009.

TECHNICAL Field

The invention concerns a method and an arrangement for the improvement of a wash after completed digestion in a continuous digester for the production of cellulose pulp. Digested softened chips that have not yet undergone defibration are fed out from the bottom surface of the digester after having passed a final strainer section in the bottom of the digester. The non-defibrated chips are fed out under the influence of a bottom scraper arranged at the bottom of the digester and subsequently through a bucket-shaped outlet tap at the bottom of the digester and has the form of a bucket, and onwards to an outlet line connected to the outlet tap. This takes place before the softened chips pass through a blow-valve arranged in the outlet line, across which blow-valve a fall in pressure of at least 0.5 bar and at most 3 bar has been established.

BACKGROUND AND SUMMARY OF THE INVENTION

Production has been increased so far above the original design capacity, principally in older continuous digesters, that the conventional digester wash at the bottom of the digester has essentially been eliminated. It is often the case in these overloaded digesters that the dilution factor at the bottom of digester is 0, and in certain extreme cases it may be negative. The dilution factor is the factor that specifies the quantity of washing or dilution liquid that is added at the bottom of the digester relative to the current quantity of cooking fluid in the digester. For a dilution factor of 2.0, as is often desired, 2.0 cubic meters of washing or dilution liquid is added at the bottom of the digester per tonne of pulp (2.0 cubic meters/ADT).

Also new digester plants are designed such that the greater part of the digester is used as cooking zone, such that a longer retention time in the cooking process is obtained, which allows the cooking temperature required to achieve the H factor that is required for delignification to be reduced. A longer retention time and lower cooking temperature are beneficial for the strength and yield of pulp, since the cellulose is broken down to a lesser degree, and they also give better control of the cooking process.

Large digesters with capacities of over 4000 tonnes of pulp per day have extremely large diameters, greater than 12 meters, at the bottom of the digester, and this means that it becomes extremely difficult to establish a good displacement of the free fluid from between the softened chips by the addition and withdrawal of washing or dilution liquid through the wall of the digester and arrangements having central pipes.

The conventional technology for adding washing or dilution liquid through vertical and horizontal nozzles in the wall at the bottom surface of the digester often leads to the formation of flows or a film of liquid along the inner wall of the digester shell down towards the outlet. These flows of low temperature with washing or dilution liquid with a relatively lower temperature can often be detected on the walls of transfer lines to subsequent storage towers or washing equipment, and in certain cases these cold flows are held intact until the inlet of the storage tower or washing equipment.

FIG. 1A shows a conventional digester of older type in which a zone W of countercurrent washing is established at the bottom of the digester up to the strainer 9 for the final withdrawal to the recovery process Rec. Horizontal nozzles $N_H$ are in this case present in the outer jacket of the digester, and vertical nozzles $N_V$ for the addition of dilution or washing fluid. A radial displacement can be established with a digestion flow 11, which displacement gives the same conditions across the cross-section. Also washing fluid is sometimes added to this flow 11. Defibration of the chips, which have been softened by the digestion process, takes place across the blow-valve 4 after the pulp has left the digester. More of the lignin that has been locked into the softened fragments of chip is released through this defibration, and a final wash takes place in suitable washing equipment, here shown as a pressure diffuser 5.

FIG. 1B shows a system that is similar in essence to that shown in FIG. 1A, but here a larger part of the digester is used as cooking zone and the wash at the bottom of the digester has been considerably reduced. This latter case is often found in overloaded digesters that have been rebuilt to provide much greater production capacity than the capacity that was originally intended.

FIG. 1C shows a further variant of FIG. 1B, in which dilution and washing fluids are added through nozzles $N_S$ on the arms of the bottom scraper. In order to achieve an efficient wash within the short space up to the strainer 2, large flows of washing fluid are required, which give rise to a lifting force that acts against the motion of the column of chips, and this directly counteracts the objective of increasing production, which requires more rapid movement of the column of chips down towards the outlet.

A known wash is shown in FIG. 1D at the bottom of the digester where washing liquid is added through a central pipe, arranged directly above the bottom scraper, and where displaced cooking fluid is withdrawn from the surrounding wall of the digester. The technology corresponds to that revealed in, for example, U.S. Pat. No. 3,475,271. A variant with several displacement stages is revealed in U.S. Pat. No. 4,213,822. One disadvantage here is that a large part of the bottom section of the digester is used for digester washing.

FIG. 1E shows known dilution technology at the bottom of the digester in which dilution liquid is added at the bottom of the digester, typically through nozzles from a source $N_H/N_V$, and where the pulp is dewatered in a subsequent dewatering arrangement 8 in the outlet line 12. The technology corresponds to that revealed in, for example, SE204236. One disadvantage here is that the dilution gives a limited wash, since the filtrate obtained from the dewaterer is recirculated as dilution liquid.

U.S. Pat. No. 3,807,202 reveals a variant of the wash of well-defibrated pulp at the bottom of towers. A stationary internal distribution space is arranged in this case in the outlet tap, with a surrounding stationary strainer. Washing liquid is added through the central distribution space and displaced liquid is withdrawn through the surrounding strainer. One disadvantage here is that the strainer and the distributor space are stationary, and the pulp must pass through a narrow gap between them. It is easy for the strainer to become clogged by fibre material and the washing process loses its effect.

Another solution for facilitating the feeding out from an impregnation vessel onwards to a digester is shown in our patent SE528571 (equivalent to WO2006101449). This solution means that withdrawal strainers are arranged in the outlet tap in order to gain help with the feed out, where the strainers aid in drawing the flow of chips down into the outlet tap. This solution has proved to work well and is part of the background of the present invention, which takes the solution one step further, and of a fully new implementation for improved displacement washing at the bottom of the digester.

THE PURPOSE OF THE INVENTION

The fall in pressure that is generated across the blow-valve gives a defibrating effect for the cooked softened chips such that the fibres are released to a greater degree and the pulp can be better washed in a subsequent washing process, preferably a pressure diffuser arranged directly after the digester.

It is desired to implement an displacement wash at the relevant process position before the blow-valve between the softened fragments of chip such that the free liquid between the fragments of chip can be exchanged from a free liquid, typically consumed cooking fluid or black liquor, with a high content of dissolved organic material, principally but not exclusively lignin, to a cleaner liquid with a lower content of dissolved organic material.

After defibration in the exchanged cleaner liquid, organic material that was bound in the softened chips can more easily enter solution and the total washing efficiency from the subsequent wash can be considerably improved.

A first purpose of the invention is to achieve an improved displacement wash of the digested and softened chips before defibration of the chips takes place across the blow-valve.

A second purpose is to be able to install this displacement wash in already existing parts of the equipment at the digester plant, such that no further equipment or components are required. An displacement wash can be obtained for very low additional costs when installing the invention at new digester plants.

A third purpose is to be able to offer, by the rebuilding of existing equipment, an increase in the dilution factor in overloaded digesters, where the production has been increased from the original design capacity so much that the dilution factor has been severely reduced, and in certain cases even eliminated.

The method according to the invention relates to the improvement of a wash after completed digestion in a continuous digester for the production of cellulose pulp. In the method, softened chips are fed out from the bottom surface of the digester after having passed a final strainer section in the bottom of the digester. The softened chips are fed out under the influence of a bottom scraper arranged at the bottom of the digester and subsequently through a bucket-shaped outlet tap at the bottom of the digester, and onwards to an outlet line connected to the outlet tap. Finally, the softened chips pass through a blow-valve arranged in the outlet line, across which blow-valve a fall in pressure of at least 0.5 bar and at most 3 bar has been established. What is characteristic for the method according to the invention is that the softened chips are exposed to a radially directed displacement wash after having passed the bottom scraper, which displacement wash is established in the flow of cooked softened chips through the outlet tap and preferably also in the flow through the outlet line, before the softened chips are defibrated through the fall in pressure across the blow-valve.

It is preferable that the displacement wash be established between wash nozzles on the shaft of the bottom scraper and strainer sections in the walls of the outlet tap.

It is preferable that the displacement wash be also established between two opposing walls of the outlet line, where one wall has nozzles for the addition of washing fluid and the second opposing wall has strainer surfaces for the withdrawal of liquid.

The displacement wash in the outlet tap preferably exchanges between 0.1 and 2 cubic meters of liquid per tonne of pulp (ADT "air-dried tonne") through the addition of washing fluid through the shaft of the bottom scraper and withdrawal through the strainer sections in the wall of the outlet tap.

The displacement wash in the outlet line through the addition and withdrawal in the opposing walls preferably exchanges between 0.1 and 2 cubic meters of liquid per tonne of pulp (ADT) for each 2 meters of outlet line.

The invention concerns also an arrangement for the improvement of a wash after completed cooking in a continuous digester for the production of cellulose pulp, which arrangement is installed at a position in which cooked softened chips are fed out from the bottom surface of the digester after having passed a final strainer section in the bottom of the digester. The softened chips are fed out under the influence of a bottom scraper arranged at the bottom of the digester and subsequently through a bucket-shaped outlet tap at the bottom of the digester, and onwards to an outlet line connected to the outlet tap before the softened chips pass through a blow-valve arranged in the outlet line, across which blow-valve a pressure drop of at least 0.5 bar and at most 3 bar has been established. The arrangement is characterised in that a number of nozzles for the addition of washing fluid from a source of washing fluid are arranged on the shaft of the bottom scraper at the height of the outlet tap, and in that the inner surface of the outlet tap is provided with strainer surfaces for the withdrawal of displaced cooking fluid. These nozzles are thus arranged in opposition to the strainer surfaces in order to establish a radially directed displacement through the flow of pulp that passes through the outlet tap.

In order to keep the withdrawal strainers clean, the arrangement has at least one essentially vertically arranged scraper fixed arranged and co-rotating on the shaft of the bottom scraper, which scraper sweeps across the strainer surface at a predetermined distance.

It is preferable that the arrangement have a number of nozzles for the addition of washing fluid from a source of washing fluid arranged on the arms of the bottom scraper directly above the opening of the outlet tap.

BRIEF DESCRIPTION OF THE DRAWINGS

The invention and the prior art technology will be described with reference to the following drawings, in which:

FIGS. 1A-1E show various known designs of washing zones in the bottom of a continuous digester.

DETAILED DESCRIPTION OF THE INVENTION

The concept of "nozzles" will be used in the following detailed description, and this concept is here used to denote either one or several individual mouthpieces, or distribution plates with holes, which distribution plates add fluid.

Figure 1A:
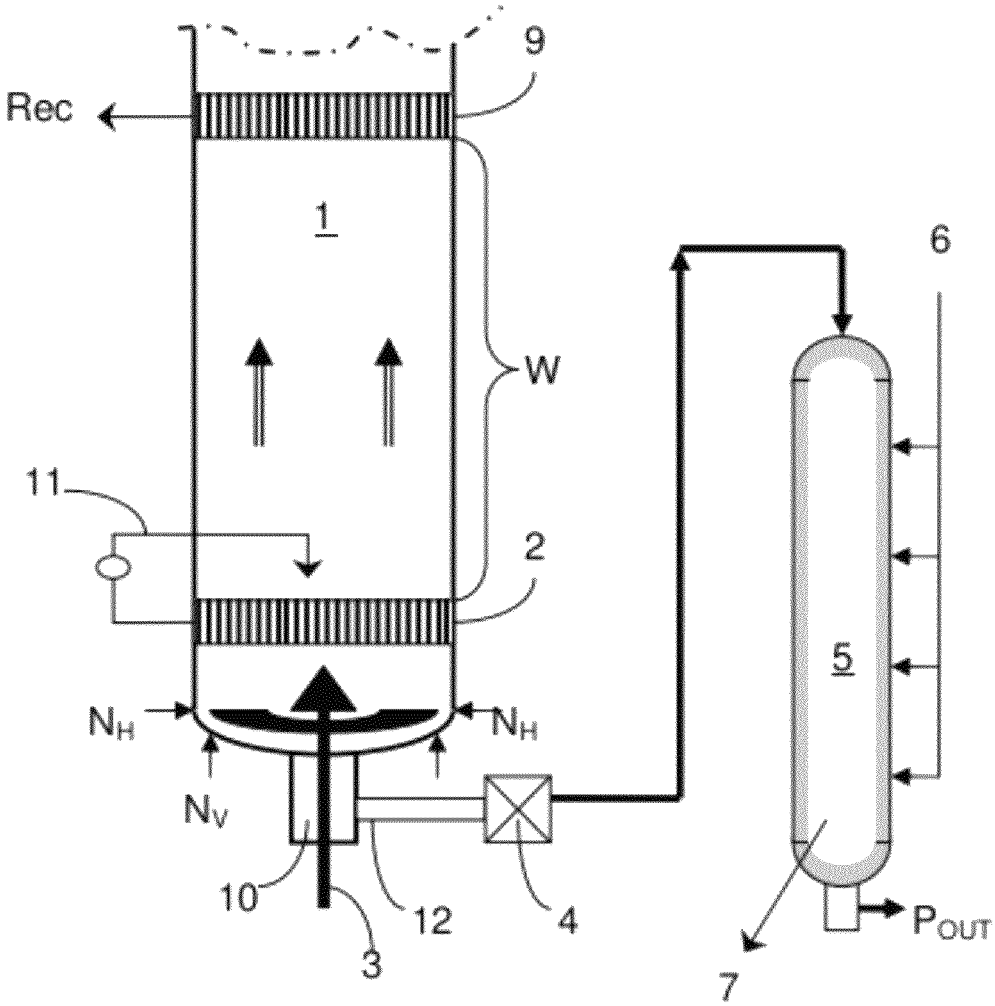
Fig. 1A Prior Art
Figure 1C:
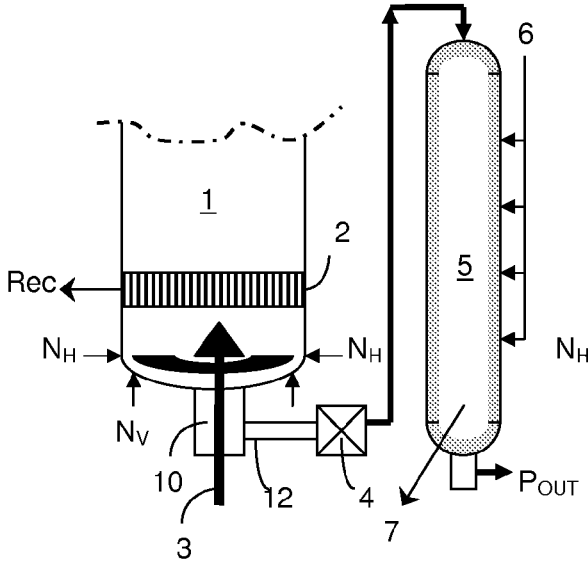
Fig. 1C Prior Art
Figure 1C:
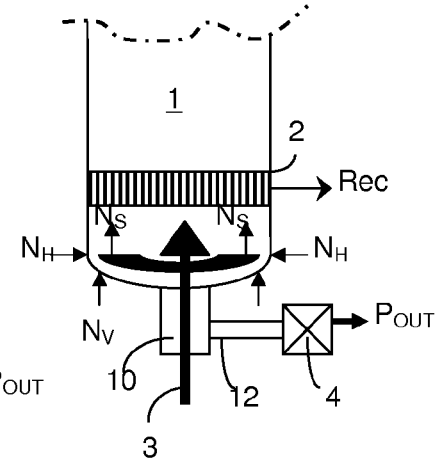
Fig. 1C Prior Art
Figure 1D:
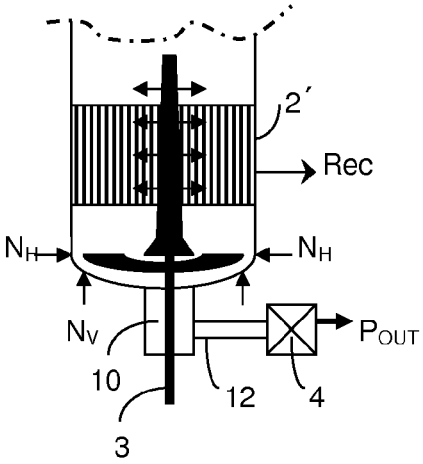
Fig. 1D Prior Art
Figure 1E:
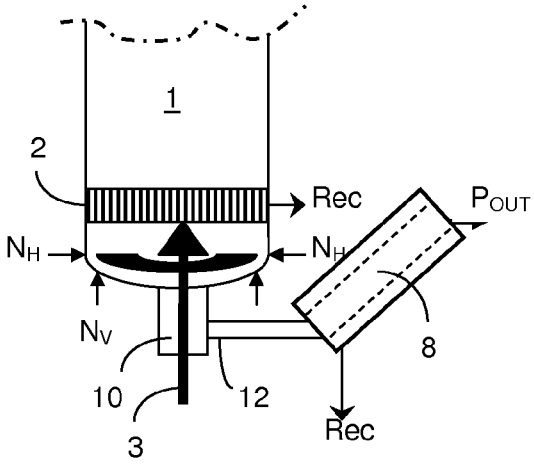
Fig. 1E Prior Art
Figure 2:
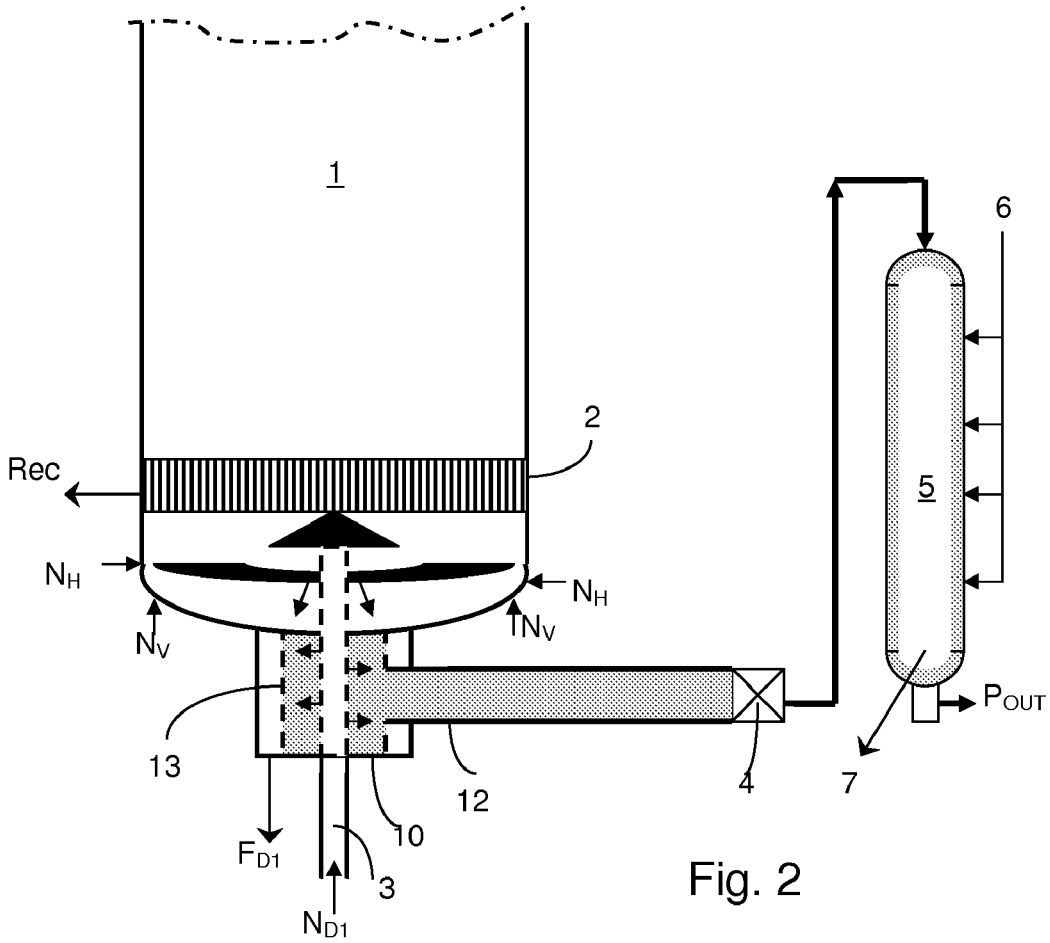
FIG. 2 shows an embodiment of the present invention.
Figure 4:
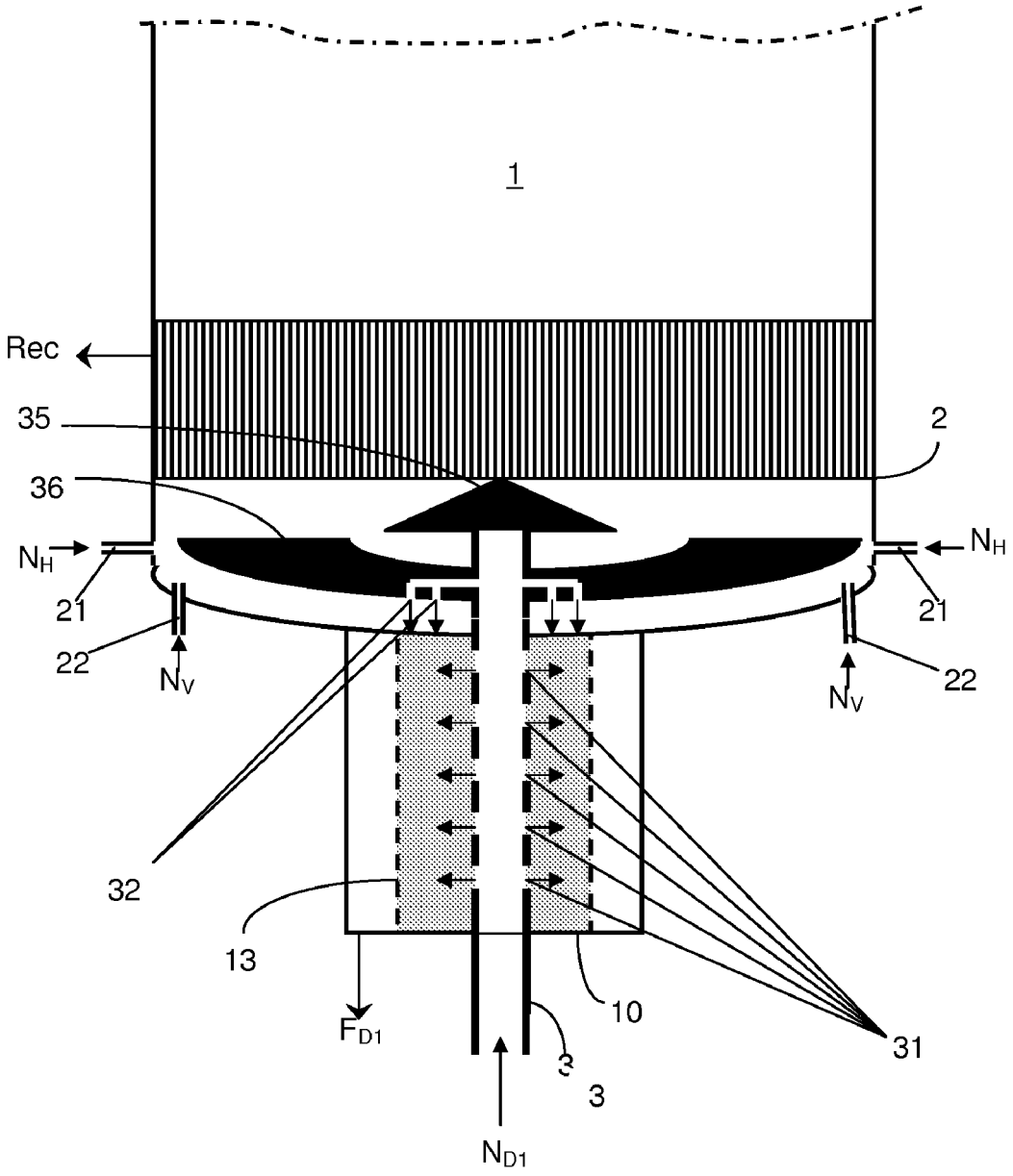
FIG. 4 shows an alternative embodiment of the present invention of the outlet tap.

A first embodiment of the invention is shown in FIG. 2, where one part is shown in a larger format in FIG. 4. The arrangement is located at the bottom of a continuous digester 1, and under the final strainer section 2 in the outer cover of the digester and before a blow-valve 4. The digested softened chips are fed out under the influence of a bottom scraper driven by a shaft 3 arranged at the bottom of the digester and subsequently through a bucket-shaped outlet tap 10 at the bottom of the digester, and onwards to an outlet line 12 connected to the outlet tap before the softened chips pass through a blow-valve 4 arranged in the outlet line. The pulp, which has been defibrated by the pressure drop, is fed after the blow-valve 4 to washing equipment, shown here as a conventional pressure diffuser 5, where washing fluid 6 is led into the bed of pulp from outside and a filtrate 7 is withdrawn from the centre of the pressure diffuser.

A pressure drop of at least 0.5 bar and at most 3 bar is established across the blow-valve. The arrangement is characterised in that a number of nozzles 31, see FIG. 4, for the addition of washing fluid from a source $N_{D1}$ of washing fluid are arranged on the shaft of the bottom scraper at the height of the outlet tap 10, and in that the inner surface of the outlet tap is provided with strainer surfaces 13 for the withdrawal of displaced cooking fluid $F_{D1}$, which is led away. The filtrate $F_{D1}$ is collected in a filtrate chamber between the strainer surface 13 and the outer cover of the outlet tap 10.

Figure 3:
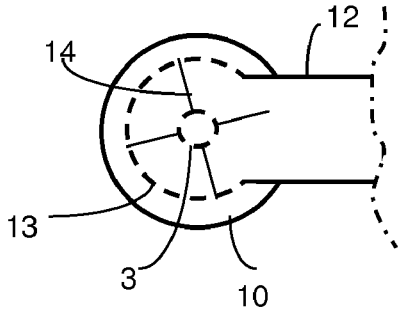
FIG. 3 shows a section through the outlet tap seen from above in FIG. 2.

As is shown in FIG. 3, it is preferable that the arrangement have at least one essentially vertically arranged scraper 14 (four scrapers are shown in the drawing) that is fixed arranged and co-rotating on the shaft 3 of the bottom scraper, which scraper sweeps across the strainer surface at a predetermined distance. The scraper can in this manner keep the withdrawal strainers free from clogging.

As is shown in more detail in FIG. 4, it is appropriate that the arrangement have also a number of nozzles 32 arranged at the arms 36 of the bottom scraper directly above the opening of the outlet tap 10 for the addition of washing fluid from a source of washing fluid $N_{D1}$.

In order to obtain an efficient displacement wash through the bed of pulp between the strainer surface 13 and the shaft of the bottom scraper, the nozzles 31 on the shaft are arranged at a similar height and opposite to the strainer surface 13, seen in the horizontal direction.

The arms of the bottom scraper sweep across the complete bottom of the digester, but the nozzles 32 as such are arranged directly above the opening of the outlet tap, and they are located at a radial position on the arms 36 of the bottom scraper that sweep across this opening.

The nozzles 31, 32 are thus located on the rotating bottom scraper within an area from the bottom wall 10*b* of the outlet tap and to that part of the arm of the bottom scraper that is located in a vertical plane that contains the strainer surface 13.

IMPLEMENTATION

For a continuous digester with a capacity of over 4,000 tonnes (ADT) pulp per day, the diameter of the bottom of the digester is 12.5 m. The outlet tap for this size of digester typically has a diameter of 2.1 m and a height of 1.1 m. With a typical strainer loading, i.e. the withdrawal capacity of the strainer surface, of 5-10 cubic meters/hour/$m^2$, it is possible in a digester of this size to establish a withdrawal volume of 36-72 cubic meters/hour from the outlet tap. Through the addition of a corresponding volume of washing fluid in the nozzles 31 and 32, it is possible to establish a radially established displacement wash through the softened chips that will not have a detrimental effect on the path of the column of chips in the digester. Washing fluid that is added through vertical or horizontal nozzles, such as $N_V$ and $N_H$, has a tendency instead to form a film of fluid along the bottom wall of the digester, and does not give the same displacement effect. Also the other prior art solution, which involves the addition of washing or dilution liquid through the bottom scraper, such as the nozzles $N_S$, has a tendency to instead form flows of washing fluid in the pulp under the bottom scraper.

While the present invention has been described in accordance with preferred compositions and embodiments, it is to be understood that certain substitutions and alterations may be made thereto without departing from the spirit and scope of the following claims.

The invention claimed is:

1. A method for the improvement of a wash after a completed digestion process in a digester for the production of cellulose pulp, comprising:

digested softened chips passing a final strainer-section at a bottom of the digester, feeding out the digested softened chips from a bottom surface of the digester, subsequently feeding out the digested softened chips under an influence of a rotatable bottom scraper arranged at the bottom of the digester and thereafter through a bucket-shaped outlet tap below the bottom of the digester, providing the bucket-shaped outlet tap with a central shaft extending therethrough, the shaft having nozzles defined therein, establishing a radially directed displacement wash in a flow of the digested softened chips through the bucket-shaped outlet tap, the radially directed displacement wash being established between the nozzles and a screen surface of a wall of the bucket-shaped outlet tap, subjecting the digested softened chips to the radially directed displacement wash in the bucket-shaped outlet tap, conveying the digested softened chips onwards to an outlet line connected to the bucket-shaped outlet tap, passing the digested softened chips through a blow-valve arranged in the outlet line, establishing a fall in pressure of at least 0.5 bar and at most 3 bar across the blow-valve, and the fall in pressure across the blow-valve defibrating the digested softened chips.

2. The method according to claim 1, wherein the radially directed displacement wash is established radially outwardly between wash nozzles on the central shaft of the rotatable bottom scraper and strainer sections disposed in a wall of the bucket-shaped outlet tap.

3. The method according to claim 2, wherein the radially directed displacement wash through an addition of washing fluid through a shaft of the rotatable bottom scraper and withdrawal through the strainer sections in the wall of the outlet tap exchange between 0.1 and 2 cubic meters of liquid per tonne of pulp (ADT).

4. An arrangement for the improvement of a wash after the completion of digestion in a digester for the production of cellulose pulp, comprising:

the digester having a final strainer-section disposed at a bottom of the digester, the digester having feeding-out means for feeding-out the digested softened chips from a bottom surface of the digester, the digester having a bottom scraper arranged at the bottom of the digester, the bottom scraper having a shaft connected thereto, the shaft having a number of nozzles defined in the shaft, the shaft being in fluid communication with a washing fluid source ($N_{D1}$), the digester having a bucket-shaped outlet tap disposed below the bottom scraper, the shaft extending through the bucket-shaped outlet tap and the nozzles being arranged on the shaft inside the bucket-shaped outlet tap, the bucket-shaped outlet tap having an inner surface provided with a strainer surface having means for withdrawing a cooking fluid, an outlet line connected to the bucket-shaped outlet tap, and a blow-valve arranged in the outlet line.

5. The arrangement according to claim 4, wherein at least one essentially vertically arranged scraper is fixedly arranged on the shaft of the bottom scraper, the scraper having sweeping means for sweeping across the strainer surface at a predetermined distance.

6. The arrangement according to claim 5, wherein a number of nozzles for the addition of washing fluid from a source of washing fluid are arranged on arms of the bottom scraper directly above an opening of the outlet tap.

* * * * *